US009054450B2

(12) United States Patent
Nagasaki et al.

(10) Patent No.: US 9,054,450 B2
(45) Date of Patent: Jun. 9, 2015

(54) CONNECTOR

(71) Applicant: Tyco Electronics Japan G.K., Kanagawa-ken (JP)

(72) Inventors: Taisuke Nagasaki, Kanagawa (JP); Hirokazu Kato, Kanagawa (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 173 days.

(21) Appl. No.: 13/712,462

(22) Filed: Dec. 12, 2012

(65) Prior Publication Data

US 2013/0149879 A1 Jun. 13, 2013

(30) Foreign Application Priority Data

Dec. 12, 2011 (JP) ..... 2011-271315

(51) Int. Cl.

| | |
|---|---|
| ***H01R 13/73*** | (2006.01) |
| ***H01R 13/62*** | (2006.01) |
| ***H01R 12/58*** | (2011.01) |
| ***H01R 13/24*** | (2006.01) |
| ***H01R 12/57*** | (2011.01) |
| ***H01R 33/76*** | (2006.01) |
| ***H01R 12/70*** | (2011.01) |
| *H01R 13/74* | (2006.01) |

(52) U.S. Cl.

CPC ..... *H01R 13/62* (2013.01); *H01R 12/585* (2013.01); *H01R 13/24* (2013.01); *H01R 12/57* (2013.01); *H01R 33/7642* (2013.01); *H01R 12/7029* (2013.01); *H01R 13/743* (2013.01)

(58) Field of Classification Search

USPC ..... 439/65, 81, 544, 549, 567, 554

See application file for complete search history.

(56) References Cited

U.S. PATENT DOCUMENTS

| | | | | | |
|---|---|---|---|---|---|
| 2,794,962 | A | * | 6/1957 | Donato | 439/554 |
| 2,922,978 | A | * | 1/1960 | Engel | 439/82 |
| 2,936,437 | A | * | 5/1960 | Fraser et al. | 439/57 |
| 3,391,376 | A | * | 7/1968 | Hammell et al. | 439/329 |
| 3,596,235 | A | * | 7/1971 | Teurlings | 439/748 |
| 3,951,494 | A | * | 4/1976 | Romine | 439/81 |

(Continued)

FOREIGN PATENT DOCUMENTS

JP 2005-285352 10/2005

OTHER PUBLICATIONS

European Search Report, dated Apr. 26, 2013, 6 pages.

*Primary Examiner* — Neil Abrams
*Assistant Examiner* — Travis Chambers
(74) *Attorney, Agent, or Firm* — Barley Snyder

(57) ABSTRACT

A connector adapted to: (a) extend through an opening in a board to protrude from both a top surface of the board and a bottom surface of the board, (b) secure the connector to the board, and (c) electrically connect a power supply to a terminal on the board. The connector includes a housing having: (a) a leg section, (b) a head section at a first end of the leg section of the housing, and (c) a receiving recess at a second end of the leg section adapted to receive the power supply board. This connector also includes an elastically deformable retainer piece having: a) a cantilever spring section fixed at a first end to the leg section of the housing and adapted to be below the bottom surface of the board, and (b) an apex section at a second end of the cantilever spring section adapted to bear against the bottom surface of the board. This connector further includes an elastically deformable contact protruding from the head section of the housing adapted to contact the terminal of the board.

14 Claims, 10 Drawing Sheets

(56) References Cited

U.S. PATENT DOCUMENTS

| | | | | | |
|---|---|---|---|---|---|
| 4,758,168 | A | * | 7/1988 | Awakowicz et al. | 439/83 |
| 4,934,943 | A | * | 6/1990 | Klein et al. | 439/65 |
| 5,169,322 | A | * | 12/1992 | Frantz et al. | 439/82 |
| 5,197,891 | A | * | 3/1993 | Tanigawa et al. | 439/83 |
| 5,334,049 | A | | 8/1994 | Kachlic et al. | |
| 5,487,680 | A | * | 1/1996 | Yamanashi | 439/552 |
| 5,513,082 | A | * | 4/1996 | Asano | 362/656 |
| 5,525,072 | A | * | 6/1996 | Kunishi | 439/495 |
| 5,634,810 | A | * | 6/1997 | Niitsu et al. | 439/378 |
| 5,641,291 | A | * | 6/1997 | Sueki et al. | 439/83 |
| 5,800,183 | A | * | 9/1998 | Paul et al. | 439/56 |
| 5,813,871 | A | * | 9/1998 | Grabbe et al. | 439/108 |
| 5,967,837 | A | * | 10/1999 | Wolfe et al. | 439/550 |
| 6,004,140 | A | * | 12/1999 | Kato et al. | 439/65 |
| 6,091,572 | A | * | 7/2000 | Cox | 360/99.08 |
| 6,146,184 | A | * | 11/2000 | Wilson et al. | 439/374 |
| 6,224,388 | B1 | * | 5/2001 | Ahr et al. | 439/55 |
| 6,280,246 | B1 | * | 8/2001 | Sawayanagi | 439/567 |
| 6,287,130 | B1 | * | 9/2001 | Torii | 439/83 |
| 6,302,708 | B1 | * | 10/2001 | Okabe et al. | 439/78 |
| 6,315,580 | B1 | * | 11/2001 | Hurtubise et al. | 439/82 |
| 6,319,045 | B1 | * | 11/2001 | Sawayanagi et al. | 439/374 |
| 6,435,916 | B1 | * | 8/2002 | Amberg et al. | 439/651 |
| 6,579,111 | B2 | * | 6/2003 | Fukamachi | 439/247 |
| 6,619,965 | B1 | * | 9/2003 | Kihira et al. | 439/74 |
| 6,690,582 | B2 | * | 2/2004 | Sumida | 361/752 |
| 6,752,642 | B2 | * | 6/2004 | Ushiro et al. | 439/248 |
| 6,814,583 | B1 | * | 11/2004 | Young et al. | 439/65 |
| 6,988,900 | B1 | * | 1/2006 | Meister | 439/78 |
| 7,309,238 | B2 | * | 12/2007 | Yang | 439/71 |
| 7,384,278 | B2 | * | 6/2008 | Ho et al. | 439/83 |
| 7,717,580 | B2 | * | 5/2010 | Takata et al. | 362/97.1 |
| 7,789,677 | B2 | * | 9/2010 | Yang et al. | 439/83 |
| 7,850,466 | B2 | * | 12/2010 | Mostoller et al. | 439/83 |
| 8,714,990 | B2 | * | 5/2014 | Naito et al. | 439/78 |
| 8,764,459 | B2 | * | 7/2014 | Decker et al. | 439/83 |
| 8,845,349 | B2 | * | 9/2014 | Shindo et al. | 439/247 |
| 2001/0041467 | A1 | | 11/2001 | Kikuchi et al. | |
| 2002/0111064 | A1 | * | 8/2002 | Kohno | 439/547 |
| 2013/0078831 | A1 | * | 3/2013 | Chiu et al. | 439/83 |

* cited by examiner

CONNECTOR

CROSS-REFERENCE TO RELATED APPLICATIONS

This application claims the benefit of the filing date under 35 U.S.C. §119(a)-(d) of Japanese Patent Application No.: 2011-271315; filed on Dec. 12, 2011.

FIELD OF THE INVENTION

The present invention relates to an electrical connector.

BACKGROUND

It is known to make a connection via a connector in order to supply electric power to a surface of a board on which surface a component is mounted from a side of a surface opposite to the surface. For example, an LED board on which an LED device is mounted is provided in a light source unit which is built in an LED light bulb. Electric power is supplied to the LED board from a circuit board which is arranged on a side opposite to a surface on which the LED device is mounted, that is, a side of a bottom surface. For example, a first connector is soldered to a top surface of the LED board. Lead wires for supplying electric power extend from the side of the bottom surface of the LED board, and a second connector to be engaged with the first connector is connected to tips of the lead wires. In assembling the light source unit, the lead wires are gone through a gap and/or an opening of the LED board to be routed from the side of the bottom surface to the side of the top surface of the LED board, and the second connector on the tips of the lead wires is to be engaged with the first connector arranged on the top surface of the LED board.

Here, in order to simplify or mechanize the assembly work, it is conceivable to make an electrical connection without using lead wires. For example, Japanese Patent Publication JP 2002-246085A illustrates a bottom entry type connector which is inserted into an opening provided in a board from one surface side of the opening. The bottom entry type connector includes a reinforcement metal member having an elastic arm to engage with the board.

Japanese Patent Publication JP 2005-285352A also illustrates a bottom entry type connector. The bottom entry type connector includes a housing, plural lead terminals which are fixed to the housing by press-fitting and a reinforcement metal member. A holding block is provided in the housing. In addition, the reinforcement metal member attached to the housing includes a supporting piece. The plural lead terminals are arranged to make contact with the board or approach the board in a state in which the bottom entry type connector is coupled with the board. The lead terminals are soldered to the board supported by the supporting piece.

However, in the bottom entry type connector of Japanese Patent Publication JP 2002-246085A, soldering of the reinforcement member itself is essential in order to prevent floating from the board. In addition, the bottom entry type connector of Japanese Patent Publication JP 2005-285352A requires soldering the plural lead terminals. If all of the plural lead terminals are not soldered, a part of the lead terminals separates from the board, leading to electrical discontinuity failure.

SUMMARY

The present invention has been made in view of the above circumstances and provides a connector in which a secure contact state may be obtained through a simple process.

A connector according to an aspect of the present invention is to be coupled with a board which includes a top surface and a bottom surface, which is formed with an opening penetrating from the top surface to the bottom surface, which is provided with a contact point close to the opening, and in which a device receiving electric power via the contact is mounted on at least the top surface, in a state in which the connector is inserted from a side of the top surface of the board and protrudes from the both of the top surface and the bottom surface.

The connector includes:

a housing that includes a leg section and a head section, the leg section including a side surface which faces an edge of the opening when being inserted in the opening and is inserted in the opening to protrude on a side of the bottom surface of the board, the head section being positioned on the side of the top surface of the board in a state in which the leg section is inserted in the opening and including a size spreading up to a position facing the contact point with respect to a direction along the top surface of the board;

a retainer piece that includes one end which is fixed to a portion of the leg section which portion protrudes on the side of the bottom surface of the board in the state of being inserted in the opening, and a cantilever spring section which extends toward the bottom surface of the board while obliquely separating from the side surface, and which is pressed by an edge of the opening to be deformed in a direction approaching the side surface when the leg section is inserted in the opening, and an apex section of which goes through the opening to the side of the bottom surface of the board to recover from being deformed so as to prevent the board from being pulled out; and a contact that has a shape protruding from the head section toward the top surface of the board, and that is pressed by the contact point of the top surface of the board to be elastically deformed when the leg section is inserted in the opening so as to press the contact in a state of being retained by the retainer piece, and that serves for supplying electric power to the contact point.

DETAILED DESCRIPTION OF THE EMBODIMENT(S)

An exemplary embodiment according to the present invention will be described with reference to the drawings.

Figure 1:
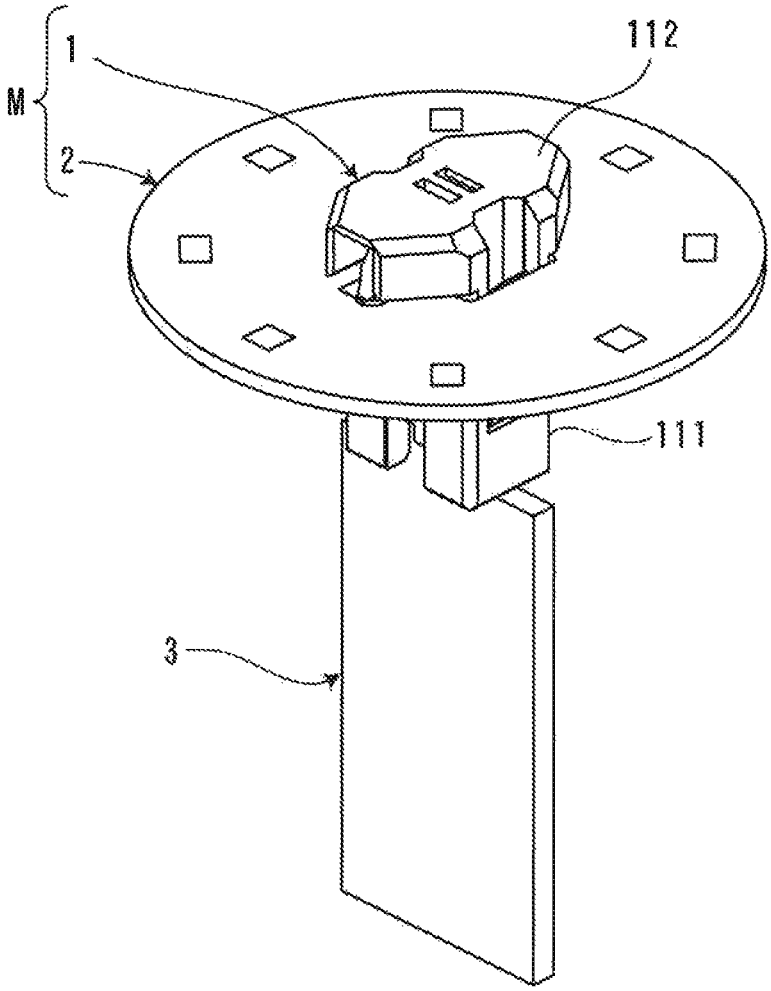
FIG. 1 is a perspective view illustrating a light source module in which an embodiment of the connector according to the present invention is used.
Figure 2:
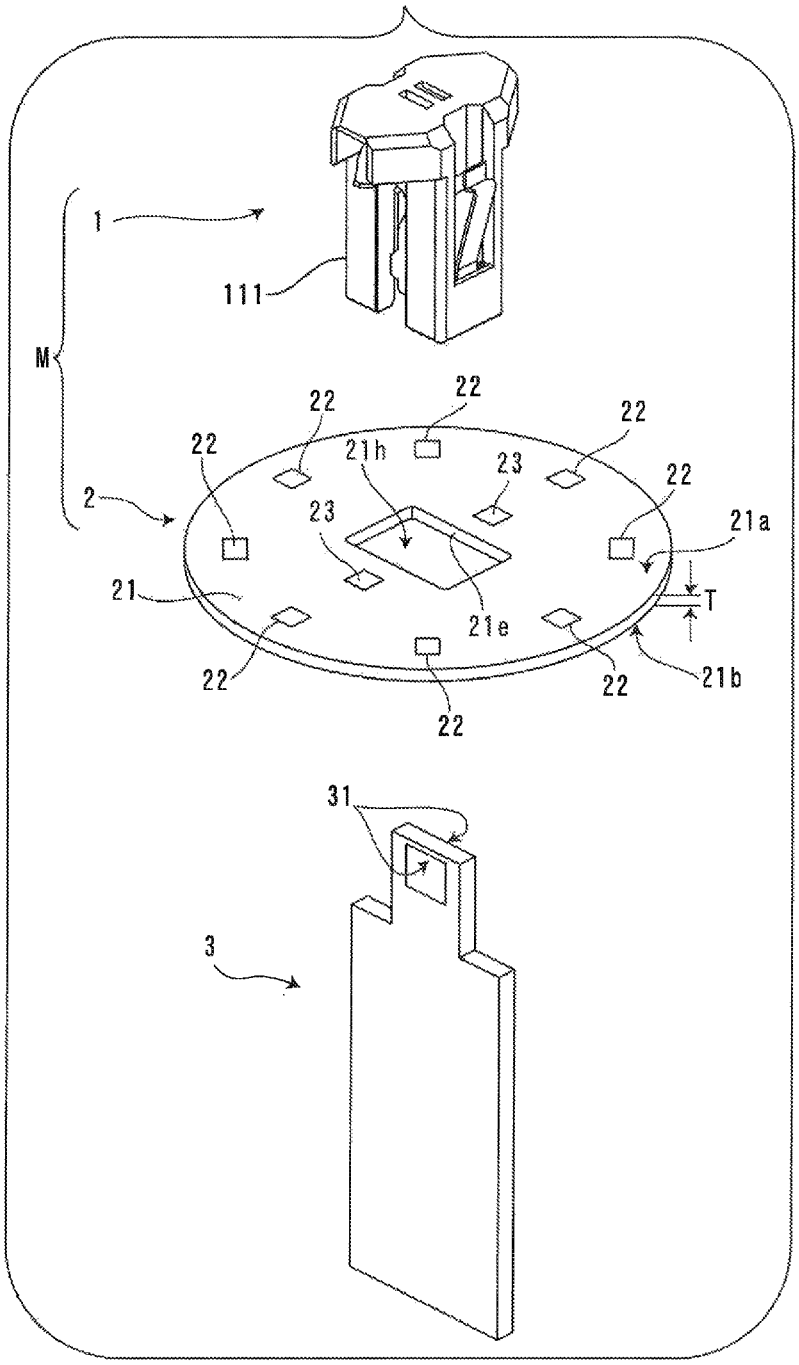
FIG. 2 is a perspective exploded view of the light source module illustrated in FIG. 1.

FIG. 1 is a perspective view illustrating a light source module in which an embodiment of the connector according to the present invention is used. In addition, FIG. 2 is a perspective exploded view of the light source module illustrated in FIG. 1. FIGS. 1 and 2 also illustrate a power supply board which supplies electric power to the light source module.

The light source module M illustrated in FIG. 1 is a component which is built in an LED light bulb (not illustrated) together with the power supply board 3. The power supply board 3 is a flat circuit board on which various electronic components (not illustrated) are mounted. For example, the power supply board 3 converts utility power supplied through the base of the light bulb to supply electric power to the light source module M. The power supply board 3 has a shape in which a portion of an edge thereof protrudes. Terminals 31 for supplying electric power to the light source module M are provided on both of a top surface and a bottom surface of this protrusion portion. Only one of the two terminals 31 is shown in FIG. 2.

The light source module M is an assembly including a connector 1 and an LED module 2. The connector 1 is an embodiment of the connector according to the present invention.

The LED module 2 includes an LED board 21 and a plurality of LED devices 22 mounted on the LED board 21. The LED board 21 is an example of the board according to the present invention, and the LED devices 22 are an example of the devices according to the present invention.

The LED board 21 has a disk shape and is provided with an opening 21*h* in a surrounding area of the center. Two terminals 23 including conductive patterns are provided close to the opening 21*h* of the LED board 21. The two terminals 23 are arranged on opposite sides of the opening 21*h*.

The LED devices 22 are connected to one of the top surface and the bottom surface of the LED board 21 by soldering or wire-bonding. The surface on which the LED devices 22 are mounted is referred to as a top surface 21*a*, and the surface opposite to the surface 21*a* is referred to as a bottom surface 21*b*. The terminals 23 of the LED board 21 are arranged on the top surface 21*a* as are the LED devices 22. The LED devices 22 and the terminals 23 are electrically coupled via conductive patterns (not illustrated) formed on the top surface 21*a* of the LED board 21 or formed in the LED board 21.

The connector 1 is a component for electrically coupling the power supply board 3 with the LED module 2 and supplying electric power from the power supply board 3 to the LED module 2. Specifically, the connector 1 electrically couples the terminals 31 of the power supply board 3, which terminals are arranged on a side of the bottom surface 21*b* of the LED board 21, with the terminals 23 arranged on the top surface 21*a* of the LED board 21. As illustrated in FIG. 1, the connector 1 is inserted into the opening 21*h* of the LED board 21 from the top surface 21*a* of the LED board 21. The connector 1 extends through the LED board 21 and protrudes from both of the top surface and the bottom surface of the LED board 21.

Figure 3:
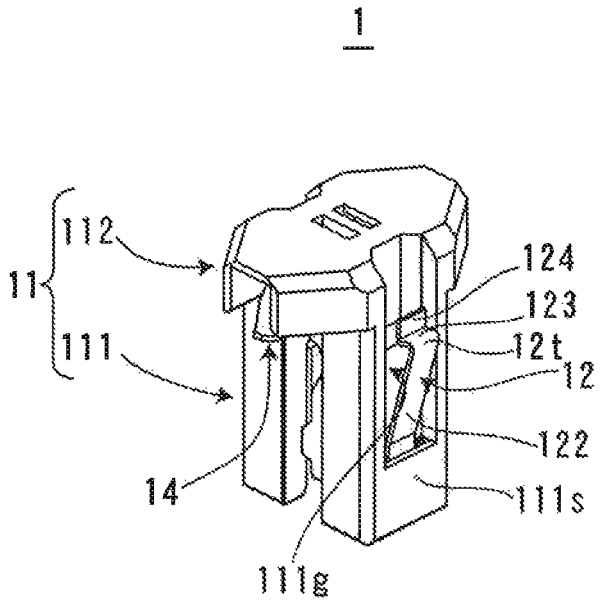
FIG. 3 is a perspective view of the connector illustrated in FIGS. 1 and 2 viewed from above.
Figure 4:
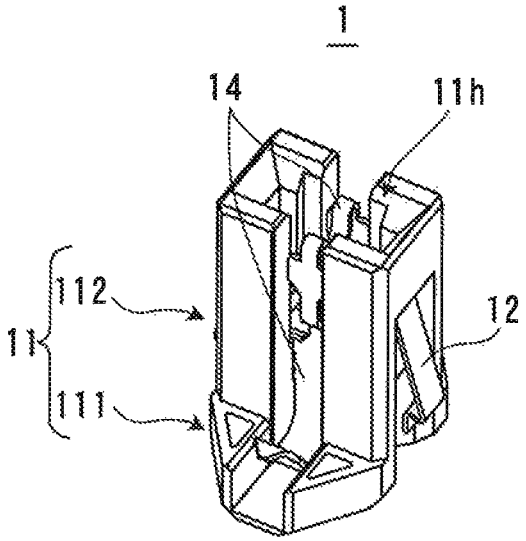
FIG. 4 is a perspective view of the connector illustrated in FIG. 3 viewed from below.
Figure 5:
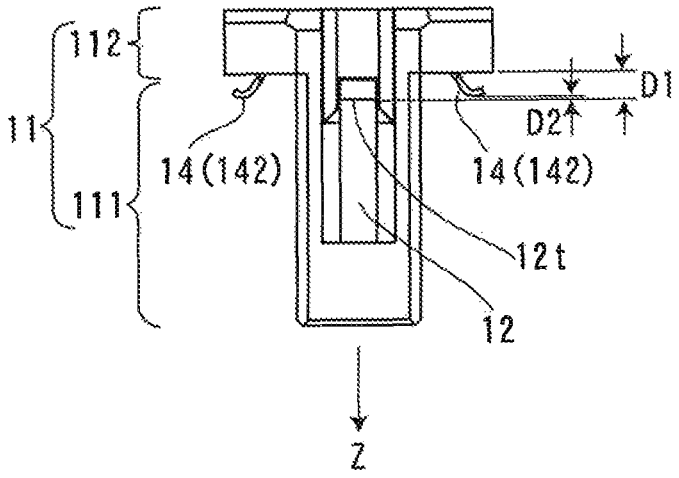
FIG. 5 is a side view of the connector illustrated in FIG. 3.

FIG. 3 is a perspective view of the connector 1 illustrated in FIGS. 1 and 2 viewed from above. FIG. 4 is a perspective view of the connector illustrated in FIG. 3 viewed from below. FIG. 5 is a side view of the connector illustrated in FIG. 3.

The connector 1 of the present embodiment includes a housing 11, two retainer pieces 12 and two contacts 14.

Figure 6:
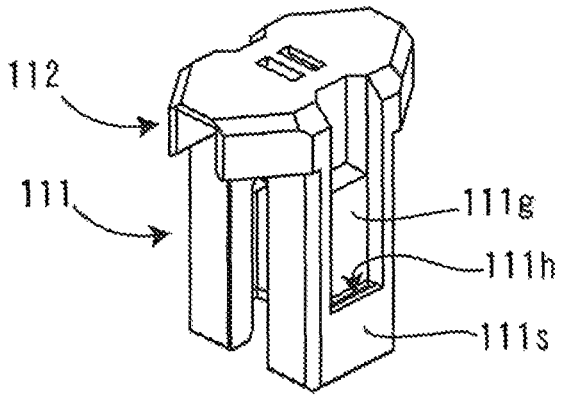
FIG. 6 is a perspective view illustrating a housing.

FIG. 6 is a perspective view illustrating the housing 11 which will be described with reference to FIGS. 3-6 collectively. The housing 11 includes a leg section 111 and a head section 112. The housing 11 is a member made of insulative resin material, and the leg section 111 and the head section 112 are integrally formed. The leg section 111 is a columnar portion to be inserted in the opening 21*h* (see FIG. 2) of the LED board 21. A side surface 111*s* of the leg section 111 faces an edge 21*e* of the opening 21*h* when the leg section 111 is inserted in the opening 21*h* (see FIG. 2). A receiving recess section 11*h* which receives a portion of the power supply board 3 (see FIG. 2) in which the terminals 31 are arranged is provided at a tip of the leg section 111.

The head section 112 is positioned on the side of the top surface 21*a* (see FIG. 2) of the LED board 21 as illustrated in FIG. 1, so that the leg section 111 is inserted in the opening 21*h* (see FIG. 2). The head section 112 has a size larger than the opening 21*h* (see FIG. 2) with respect to a direction along the top surface 21*a* (see FIG. 2) of the LED board 21. In addition, the head section 112 has a size that extends up to the terminals 23 (see FIG. 2) with respect to the direction along the top surface 21*a* (see FIG. 2) of the LED board 21.

Figure 7:
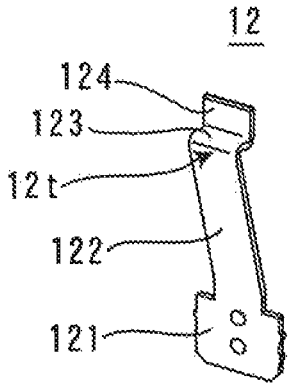
FIG. 7 is a perspective view illustrating a retainer piece.

FIG. 7 is a perspective view illustrating a retainer piece 12. The retainer pieces 12 will be described with reference to FIGS. 3-5 and FIG. 7. The retainer pieces 12 are members which prevent the housing 11 from being pulled out from the LED board 21 when the housing 11 is coupled with the LED board 21 (see FIG. 2). The retainer pieces 12 are members formed by stamping and forming a metal plate having the elasticity. As illustrated in FIG. 7, each of the retainer pieces 12 includes a fixed section 121, a cantilever spring section 122, a curved section 123 and an interior section 124. Here, a combination of the fixed section 121 and the cantilever spring section 122 is an example of the cantilever spring section according to the present invention.

The fixed section 121 is arranged at one end of each of the retainer pieces 12 and is fixed to the housing 11. Specifically, the fixed section 121 is fixed to a portion of the leg section 111 in the housing 11 which portion protrudes from the bottom surface 21*b* (see FIG. 2) of the LED board 21 as it is being inserted in the opening 21*h* (see FIG. 2). As illustrated in FIG. 6, a groove 111*g* is provided on a side surface 111*s* of the leg section 111 of the housing 11. The fixed section 121 is press-fitted to be fixed to an opening 111*h* provided in a wall of the groove 111*g* of the fixed section 121.

The cantilever spring section 122 is a portion continuously extending from the fixed section 121. The cantilever spring section 122 extends obliquely toward the head section 112 away from the side surface 111*s* (the groove 111*g*) of the housing 11. The curved section 123 continues from the cantilever spring section 122 and curves from a tip of the cantilever spring section 122 to extend toward the side surface 111*s*. A tip of the cantilever spring section 122, that is, an interface between the cantilever spring section 122 and the curved section 123 is an apex section 12*t* protruding from the side surface 111*s* of the housing 11. The interior section 124 is a portion which is curved from a tip of the curved section 123 which tip is on a side approaching the leg section 111 toward the head section 112 of the housing 11. The interior section 124 is to be arranged inside the opening 21*h* (see FIG.

2) of the LED board 21 when the connector 1 is coupled with the LED board 21 (see FIG. 2). The cantilever spring section 122 and the curved section 123 of each of the retainer pieces 12 protrude from the side surface 111*s* of the housing 11 with the apex section 12*t* as an apex. However, since the retainer pieces 12 are cantilever springs, when receiving forces toward the side surfaces 111*s*, the retainer pieces 12 are deformed and accommodated in the grooves 111*g* of the leg section 111 in the housing 11.

Figure 8:
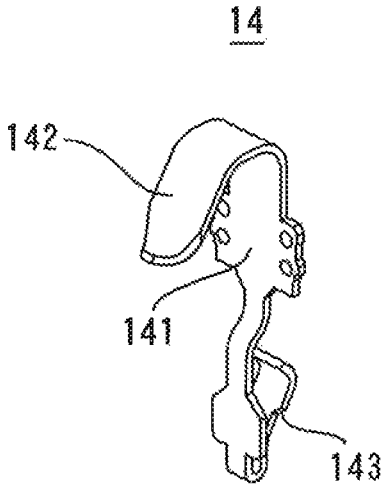
FIG. 8 is a perspective view illustrating a contact.

FIG. 8 is a perspective view illustrating a contact 14 which will be described with reference to FIGS. 3-5 and FIG. 8. The contacts 14 are electrically conductive members formed by stamping and forming a metal plate. As illustrated in FIG. 8, each of the contacts 14 includes a fixed section 141, a first contact section 142 and a second contact section 143.

The fixed section 141 is a portion to be fixed by press-fitting to the housing 11. The first contact section 142 and the second contact section 143 extend in opposite directions from the fixed section 141, respectively. The first contact section 142 makes contact with one of the terminals 23 (see FIG. 2) provided on the top surface 21*a* of the LED board 21. In addition, the second contact section 143 makes contact with one of the terminals 31 (see FIG. 2) of the power supply board 3. The first contact section 142 extends from the fixed section 141, and protrudes from the head section 112 of the housing 11, as illustrated in FIG. 5.

Figure 9:
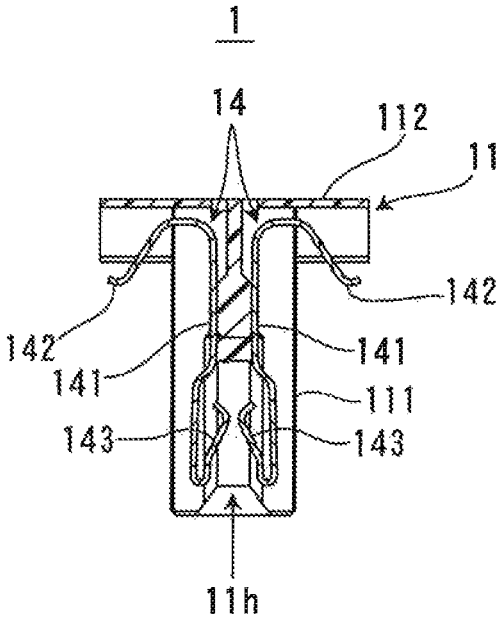
FIG. 9 is a sectional view illustrating a cross section through the contact of the connector illustrated in FIG. 5.

FIG. 9 is a sectional view illustrating a cross section through the contact of the connector illustrated in FIG. 5.

The fixed sections 141 of the contacts 14 are fixed by press-fitting to the leg section 111 of the housing 11. The first contact sections 142 extend from the fixed section 141 toward the head section 112 of the housing 11. The first contact sections 142 curve inside the head section 112 and protrude downward from the bottom surface of the head section 112. Specifically, the first contact sections 142 protrude toward the top surface 21*a* (see FIG. 2) of the LED board 21 in the direction in which the leg section 111 of the connector 1 is being inserted in the opening 21*h* (see FIG. 2) of the LED board 21.

The second contact sections 143 extend from the fixed sections 141 in a direction opposite to the first contact sections 142, that is, toward the tip of the leg section 111. The second contact sections 143 are curved as being folding back inside the leg section 111. Tip portions of the second contact sections 143 are exposed inside the receiving recess section 11*h* which receives the power supply board 3 and opens at the tip of the leg section 111 of the housing 11. The two second contacts 143 face each other inside the receiving recess 11*h*. The two second contacts 143 make contact with the terminals 31 (see FIG. 2) provided on both surfaces of the power supply board 3 when the protrusion portion on which the terminals 31 (see FIG. 2) are provided is inserted in the receiving recess 11*h*. At this moment, the two second contact sections 143 are elastically deformed and pinch the power supply board 3 with an elastic force.

Referring to FIG. 5 again, arrangements of the retainer pieces 12 will be described. A distance D1 from the apex section 12*t* of each of the retainer pieces 12 to the bottom surface of the head section 112 is larger than the thickness T (see FIG. 2) of the LED board 21 in the insertion direction Z in which the leg section 111 of the connector 1 is inserted in the opening 21*h*. In addition, a distance D2 from the apex section 12*t* of each of the retainer pieces 12 to the first contact section 142 of each of the contacts 14 is smaller than the thickness T (see FIG. 2) of the LED board 21 in the insertion direction Z.

Figure 10:
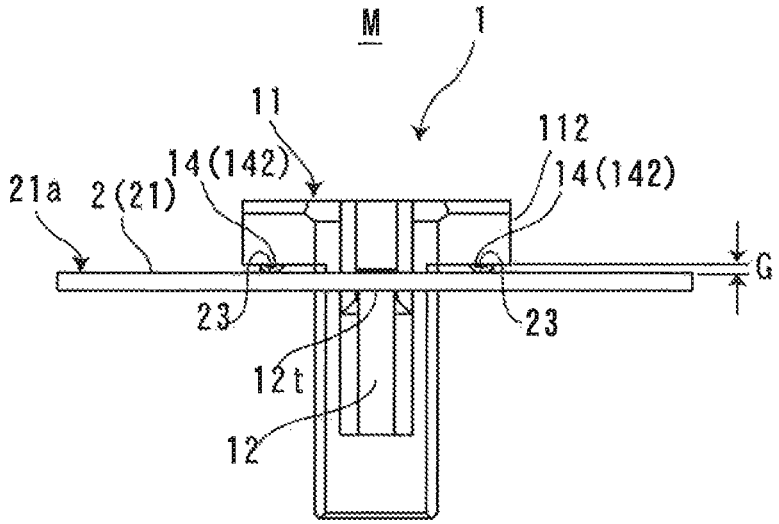
FIG. 10 is a front view illustrating the light source module.
Figure 11:
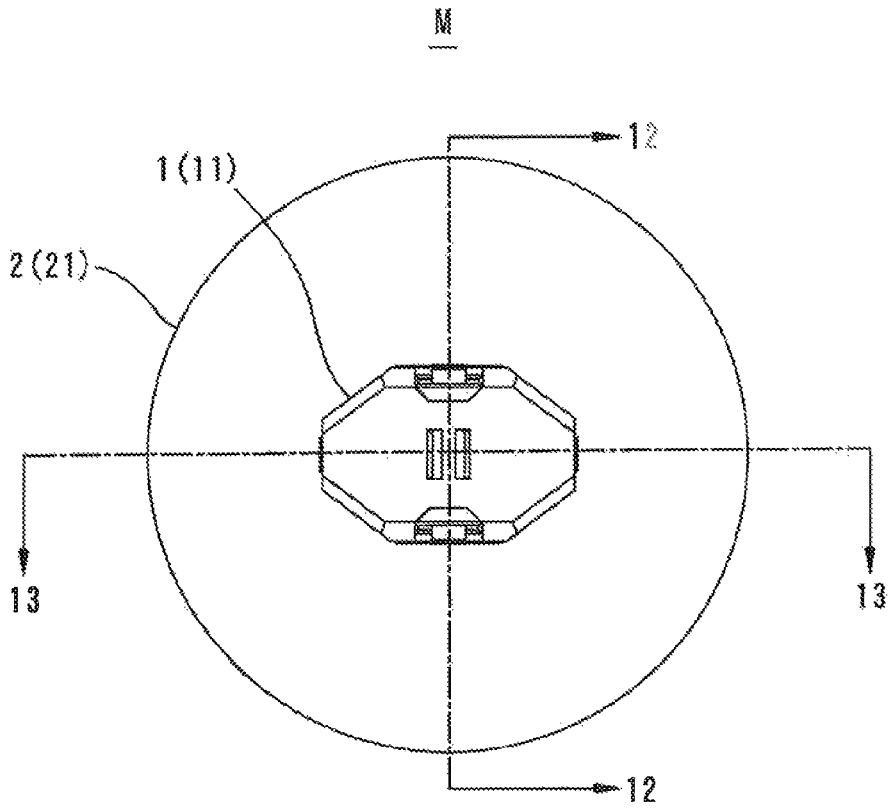
FIG. 11 is a plan view illustrating the light source module.

In the following, assembling of the above-described connector 1 to the LED module 2 and a light source module will be described. FIG. 10 is a front view illustrating the light source module M. In addition, FIG. 11 is a plan view illustrating the light source module M. The LED devices 22 of the LED module are not shown in FIG. 10 or in FIG. 11.

In the light source module M illustrated in FIGS. 10 and 11, the housing 11 of the connector 1 penetrates the LED board 21. In addition, the contacts 14 of the connector 1, specifically, the first contact sections 142 of the contacts 14 make contact with the terminals 23 provided on the top surface 21*a* of the LED board 21.

Figure 12:
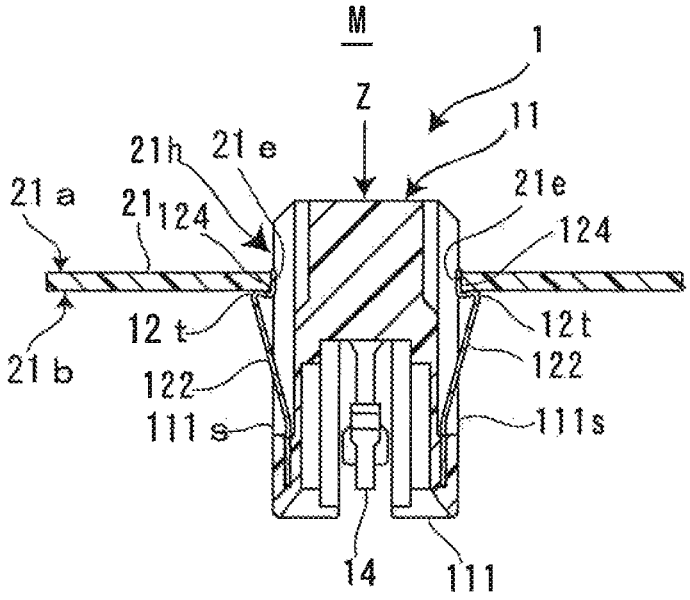
FIG. 12 is a sectional view illustrating a cross section of the light source module M illustrated in FIG. 11, taken along the line 12-12.

FIG. 12 is a sectional view illustrating a cross section of the light source module M illustrated in FIG. 11, taken along the line 12-12 of FIG. 11.

As described above, the cantilever spring section 122 included in each of the retainer pieces 12 of the connector 1 extends obliquely toward the bottom surface 21*b* of the LED board 21 and away from the side surface 111*s* of the leg section 111 of the housing 11. The tip of the cantilever spring section 122 is the apex section 12*t*.

In assembling the light source module M, the leg section 111 of the connector 1 is inserted in the opening 21*h* of the LED board 21. The leg section 111 is inserted in the opening 21*h* while the side surfaces 111*s* are faced against the edge 21*e* of the opening 21*h*. When the leg section 111 is inserted in the opening 21*h*, the cantilever spring section 122 of each of the retainer pieces 12 is pressed to be deformed by the edge 21*e* of the opening 21*h*. The cantilever spring sections 122 are deformed toward the side surfaces 111*s*. When the apex section 12*t* of each of the retainer pieces 12 goes through the opening 21*h* and reaches the bottom surface 21*b* of the LED board 21, each of the retainer piece 12 recovers from being deformed. At this moment, as illustrated in FIG. 12, the apex section 21*t* of the cantilever spring section 122 of each of retainer pieces 12 protrudes from each of the side surfaces 111*s* and engages with the bottom surface 21*b* of the LED board 21. Accordingly, with the apex section 21*t* bearing against the bottom surface of the LED board 21, the LED board 21 is securely prevented from separating from connector 1.

In addition, the interior section 124 of each of the retainer pieces 12 is arranged inside the opening 21*h* and is in the state of spreading along the edge 21*e* of the opening 21*h*. As a result, when, for example, an external force is applied to the LED board 21 in the insertion direction Z, the retainer pieces 12, although being spaced from the leg section 111 are not damaged.

Figure 13:
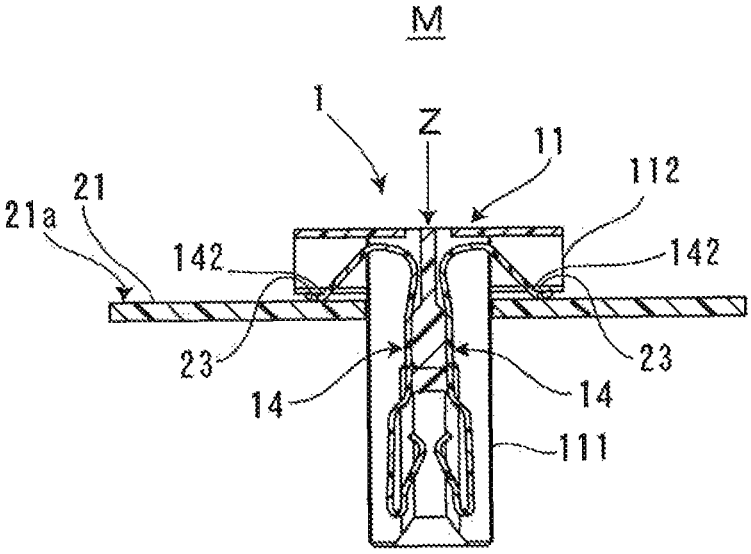
FIG. 13 is a sectional view illustrating a cross section of the light source module M illustrated in FIG. 11, taken along the line 13-13.

FIG. 13 is a sectional view illustrating a cross section of the light source module M illustrated in FIG. 11, taken along the line 13-13 of FIG. 11.

When the leg section 111 is inserted in the opening 21*h*, the contacts 14 are pressed by the terminals 23 on the top surface 21*a* of the LED board 21. Thus, the contacts 14 are deformed such that the first contact sections 142 are displaced toward the head section 112. At the time when the LED board 21 is retained by the retainer pieces 12 (see FIG. 12), the displacement amount of the first contact section 142 of the contact 14 is a difference obtained by subtracting the distance D2 (see FIG. 5) from the apex section 12*t* of the retainer piece 12 to the first contact section 142 of the contact 14 from the thickness T (see FIG. 2) of the LED board 21 illustrated in FIG. 5. The contacts 14 (see FIG. 13) press the terminals 23 by elastic forces corresponding to the displacement amount. In addition, as illustrated in FIG. 10, the contacts 14 press the LED board 21 against the apex sections 12*t* of the retainer pieces 12 with the elastic forces.

As described above, an electrical connection between the LED board 21 and the connector 1 is securely made only by an operation of inserting the leg section 111 in the opening 21*h* of the LED board 21 without using a connection by soldering. Thus, the operation of inserting is also suitable for automation with an assembly machine. In the process in which the leg section 111 is inserted in the opening 21*h*, if the leg section 111 is inserted further than the position illustrated in FIG. 10, the head section 112 abuts against the LED board 21 and thus the insertion is stopped. Accordingly, since the head section 112 serves as an anti-overstress section for the contact 14, excessive deformation of the contact 14 is prevented.

Here, as described with reference to FIG. 5, the distance D1 from the apex section 12*t* of each of the retainer pieces 12 to the head section 112 is larger than the thickness T (see FIG. 2) of the LED board 21. Accordingly, as illustrated in FIG. 10, when the connector 1 is coupled with the LED board 21, there is a space G opened between the head section 112 and the top surface 21*a* of the LED board 21. The space G is approximately equivalent to a difference obtained by subtracting the thickness T (see FIG. 2) of the LED board 21 from the distance D1 from the apex section 12*t* of each of the retainer pieces 12 to the head section 112.

The retainer pieces 12 hold the LED board 21 so that there is the space G between the LED board 21 and the head section 112. For this reason, the retainer pieces 12 are pressed toward the leg section 111 so that the pull-out prevention (retaining) by the retainer piece 12 may be smoothly released. For example, in a case in which there occurs a failure in a portion of the light source module M other than the LED module 2 after the connector is coupled with the LED board 21, it is possible to remove the LED module 2 from the connector 1 without destroying the LED module 2. Accordingly, it is possible to reuse the LED module 2. In addition, when assembling the light source module M, recovery of the retainer pieces 12, which are once pressed and deformed by the edge 21*e* of the opening 21*h* of the LED board 21, that is, the operation of pull-out prevention (retaining), is smooth.

In the above-described embodiment, the connector 1, including the two retainer pieces 12 and the two contacts 14, is described as an example of the connector according to the present invention. However, the present invention is not limited to this. For example, the number of the retainer pieces may be more than three or one, and the number of the contacts may be more than three.

In addition, the retainer pieces 12 in the above-described embodiment includes the curved sections 123 and the interior sections 124. However, the present invention is not limited to this. Each of the retainer pieces 12 may have, for example, a shape in which a tip of a cantilever spring section is cut without including the curved section and the interior section and may have a shape in which a tip of the cantilever spring portion is sheared.

Further, as illustrated and described, the LED devices are mounted on the top surface of the LED board 21 through which the connector 1 goes in the above-described embodiment. However, the board through which the connector, according to the present invention goes, is not limited to this. A board on which various electronic components are mounted may be applied, and such components may be mounted on a bottom surface of the board.

What is claimed is:

1. A connector that is to be coupled with a board which includes a top surface and a bottom surface, which is formed with an opening penetrating from the top surface to the bottom surface, which is provided with a contact point close to the opening, and in which a device receiving electric power via the contact point is mounted on at least the top surface, in a state in which the connector is inserted from a side of the top surface of the board and protrudes from the both of the top surface and the bottom surface, the connector comprising:

a housing that includes a leg section and a head section, the leg section including a side surface which faces an edge of the opening when being inserted in the opening and is inserted in the opening to protrude on a side of the bottom surface of the board, the head section being positioned on the side of the top surface of the board in a state in which the leg section is inserted in the opening and including a size spreading up to a position facing the contact point with respect to a direction along the top surface of the board;

a retainer piece that includes one end which is fixed to a portion of the leg section which portion protrudes on the side of the bottom surface of the board in the state of being inserted in the opening, and a cantilever spring section which extends toward the bottom surface of the board while obliquely separating from the side surface, and which is pressed by the edge of the opening to be deformed in a direction approaching the side surface when the leg section is inserted in the opening, and an apex section of which goes through the opening to the side of the bottom surface of the board to recover from being deformed so as to prevent the board from being pulled out; and a contact that has a shape protruding from the head section toward the top surface of the board, and that is pressed by the contact point of the top surface of the board to be elastically deformed when the leg section is inserted in the opening so as to press the contact in a state of being retained by the retainer piece, and that serves for supplying electric power to the contact point;

wherein the retainer piece includes a curved section that continues from the cantilever spring section and is curved toward the side surface from a tip of the cantilever spring section which tip extends toward the bottom surface of the board; and an interior section that is curved toward the head section from a tip of the curved section which tip is on a side approaching the leg section, and that is arranged inside the opening to spread along the edge of the opening in the state in which the connector is coupled with the board.

2. The connector according to claim 1, wherein the cantilever spring section extends toward the bottom surface of the board up to a position in which there is a space between the head section and the top surface of the board in the state in which the connector is coupled with the board.

3. A connector adapted to:

(a) extend through an opening in a board to protrude from both a top surface of the board and a bottom surface of the board, (b) secure the connector to the board, and (c) electrically connect a power supply board to a terminal on the board, the connector comprising:

a housing having:

(a) a leg section, (b) a head section at a first end of the leg section of the housing, and (c) a receiving recess at a second end of the leg section adapted to receive the power supply board;

an elastically deformable retainer piece having:

(a) a cantilever spring section fixed at a first end to the leg section of the housing and adapted to be below the bottom surface of the board;

(b) an apex section at a second end of the cantilever spring section adapted to bear against the bottom surface of the board;

(c) a curved section that continues from the cantilever spring section and is curved toward the side surface from a tip of the cantilever spring section which tip extends toward the bottom surface of the board; and (d) an interior section that is curved toward the head section from a tip of the curved section which tip is on a side approaching the leg section, and that is arranged inside the opening to spread along the edge of the opening in the state in which the connector is coupled with the board, and an elastically deformable contact protruding from the head section of the housing adapted to contact the terminal of the board.

4. The connector according to claim 3, wherein the terminal of the board is near the opening in the board.

5. The connector according to claim 4, further including:

(a) a second elastically deformable contact similar to the first elastically deformable contact:

(1) protruding from a side of the head section of the housing opposite the side from which the first elastically deformable contact protrudes from the housing, and (2) adapted to contact a second terminal of the board disposed near the opening in the board and opposite the first terminal, (b) a second elastically deformable retainer piece having:

(1) a second elastically deformable cantilever spring section:

(i) fixed at a first end to the first end of the leg section of the housing, (ii) protruding from a side of the leg section of the housing opposite the side from which the first elastically deformable cantilever spring sections protrudes from the housing, (iii) extending away from the leg section of the housing at an angle, and (iv) adapted to be below the bottom surface of the board, and (2) a second apex section at a second end of the second cantilever spring section adapted to bear against the bottom surface of the board near the opening in the board and opposite from where the first apex section is adapted to bear against the bottom surface of the board.

6. The connector according to claim 4, further including a second elastically deformable contact similar to the first elastically deformable contact and protruding from a side of the head section of the housing opposite the side from which the first elastically deformable contact protrudes and adapted to contact a second terminal of the board disposed near the opening in the board and opposite the first terminal.

7. The connector according to claim 6, further including a second elastically deformable retainer piece having:

(a) a second elastically deformable cantilever spring section:

(1) fixed at a first end to the first end of the leg section of the housing, (2) protruding from a side of the leg section of the housing opposite the side from which the first elastically deformable cantilever spring sections protrudes from the housing, (3) extending away from the leg section of the housing at an angle, and (4) adapted to be below the bottom surface of the board, and (b) a second apex section at a second end of the second cantilever spring section adapted to bear against the bottom surface of the board near the opening in the board and opposite from where the first apex section is adapted to bear against the bottom surface of the board.

8. The connector according to claim 3, wherein cantilever spring section extends away from the leg section of the housing at an angle.

9. The connector according to claim 8, further including:

(a) a second elastically deformable contact similar to the first elastically deformable contact:

(1) protruding from a side of the head section of the housing opposite the side from which the first elastically deformable contact protrudes from the housing, and (2) adapted to contact a second terminal of the board disposed near the opening in the board and opposite the first terminal, (b) a second elastically deformable retainer piece having:

(1) a second elastically deformable cantilever spring section:

(i) fixed at a first end to the first end the leg section of the housing, (ii) protruding from a side of the leg section of the housing opposite the side from which the first elastically deformable cantilever spring sections protrudes from the housing, (iii) extending away from the leg section of the housing at an angle, and (iv) adapted to be below the bottom surface of the board, and (2) a second apex section at a second end of the second cantilever spring section adapted to bear against the bottom surface of the board near the opening in the board and opposite from where the first apex section is adapted to bear against the bottom surface of the board.

10. An electrical board/connector module comprising:

a board having:

(a) a top surface, (b) a bottom surface, (c) an opening extending from the top surface of the board to the bottom surface of the board, (d) a terminal adjacent the opening in the board, and (e) a device mounted on one of the top surface of the board and the bottom surface of the board and electrically connected to the terminal of the board; and a connector extending through the opening in the board and protruding from both the top surface of the board and the bottom surface of the board, the connector including:

(a) a housing having:

(1) a leg section, (2) a head section at a first end of the leg section of the housing, and (3) a receiving recess section at a second end of the leg section of the housing adapted to receive a power supply board, (b) an elastically deformable retainer piece having:

(1) a cantilever spring section fixed at a first end to the leg section of the housing below the bottom surface of the board, (2) an apex section at a second end of the cantilever spring section bearing against the bottom surface of the board, (3) a curved section that continues from the cantilever spring section and is curved toward the side surface from a tip of the cantilever spring section which tip extends toward the bottom surface of the board, and (4) an interior section that is curved toward the head section from a tip of the curved section which tip is on a side approaching the leg section, and that is arranged inside the opening to spread along the edge of the opening in the state in which the connector is coupled with the board; and (c) a contact protruding from the head section of the housing above the top surface of the board and in contact with the terminal of the board.

11. The electrical board/connector module according to claim 10, wherein cantilever spring section extends away from the leg section of the housing at an angle.

12. The electrical board/connector module according to claim 11, further including a second elastically deformable retainer piece having:

(a) a second elastically deformable cantilever spring section:

(1) fixed at a first end to the first end of the leg section of the housing, (2) protruding from a side of the leg section of the housing opposite the side from which the first elastically deformable cantilever spring sections protrudes from the housing, (3) extending away from the leg section of the housing at an angle, and (4) being below the bottom surface of the board, and (b) a second apex section at a second end of the second cantilever spring section bearing against the bottom surface of the board near the opening in the board and opposite from where the first apex section bears against the bottom surface of the board.

13. The electrical board/connector module according to claim 11, further including a second elastically deformable contact similar to the first elastically deformable contact:

(a) protruding from a side of the head section of the housing opposite the side from which the first elastically deformable contact protrudes from the housing, and (b) contacting a second terminal of the board disposed near the opening in the board and opposite the first terminal.

14. The electrical board/connector module according to claim 11, further including:

(a) a second elastically deformable contact similar to the first elastically deformable contact:

(1) protruding from a side of the head section of the housing opposite the side from which the first elastically deformable contact protrudes from the housing, and (2) contacting a second terminal of the board disposed near the opening in the board and opposite the first terminal, and (b) a second elastically deformable retainer piece having:

(1) a second elastically deformable cantilever spring section:

(i) fixed at a first end to the first end of the leg section of the housing, (ii) protruding from a side of the leg section of the housing opposite the side from which the first elastically deformable cantilever spring sections protrudes from the housing, (iii) extending away from the leg section of the housing at an angle, and (iv) being below the bottom surface of the board, and (2) a second apex section at a second end of the second cantilever spring section bearing against the bottom surface of the board near the opening in the board and opposite from where the first apex section bears against the bottom surface of the board.

* * * * *